United States Patent [19]

Bergman

[11] 4,132,449

[45] Jan. 2, 1979

[54] METHOD AND APPARATUS FOR MOUNTING BRISTLES ON BRUSH BACKS

[75] Inventor: John E. Bergman, Huntington Bay, N.Y.

[73] Assignee: Blair Tool & Machine Corporation, College Point, N.Y.

[21] Appl. No.: 828,061

[22] Filed: Aug. 26, 1977

[51] Int. Cl.[2] ..... A46D 1/08

[52] U.S. Cl. ..... 300/4; 300/21

[58] Field of Search ..... 300/4, 8, 21

[56] References Cited

U.S. PATENT DOCUMENTS

| | | | |
|---|---|---|---|
| 2,664,316 | 12/1953 | Winslow, Jr. et al. | 300/21 |
| 3,408,112 | 10/1968 | Piotrowski | 300/4 |
| 3,910,637 | 10/1975 | Lewis, Jr. | 300/21 |

*Primary Examiner*—Granville Y. Custer, Jr.

*Attorney, Agent, or Firm*—Griffin, Branigan and Butler

[57] ABSTRACT

A method and an apparatus for joining plastic brush bristles with plastic brush backs provides for heating the tips of brush bristle strands until they are soft and heating zones of the plastic brush backs to which the bristles will be mounted until they are soft. Thereafter, the soft tips of the bristles are brought into contact with the soft zones of the brush backs to fuse the bristles to the brush backs. In the particular structure and method of the machine of this invention, two relatively movable plates alternately clamp to and unclamp from indeterminant-length bristle strands to jog the strand ends into contact with the brush backs. One of the plates carries a cutting blade which cuts the strands into bristle lengths once their tips are fastened to the brush backs. For the heating step, expandable heating plates are moved between the brush backs and the bristle strand tips and expanded to contact the bristle strand tips and the brush backs and are then contracted and retracted from between the bristles and the brush backs.

13 Claims, 3 Drawing Figures

FIG. 2
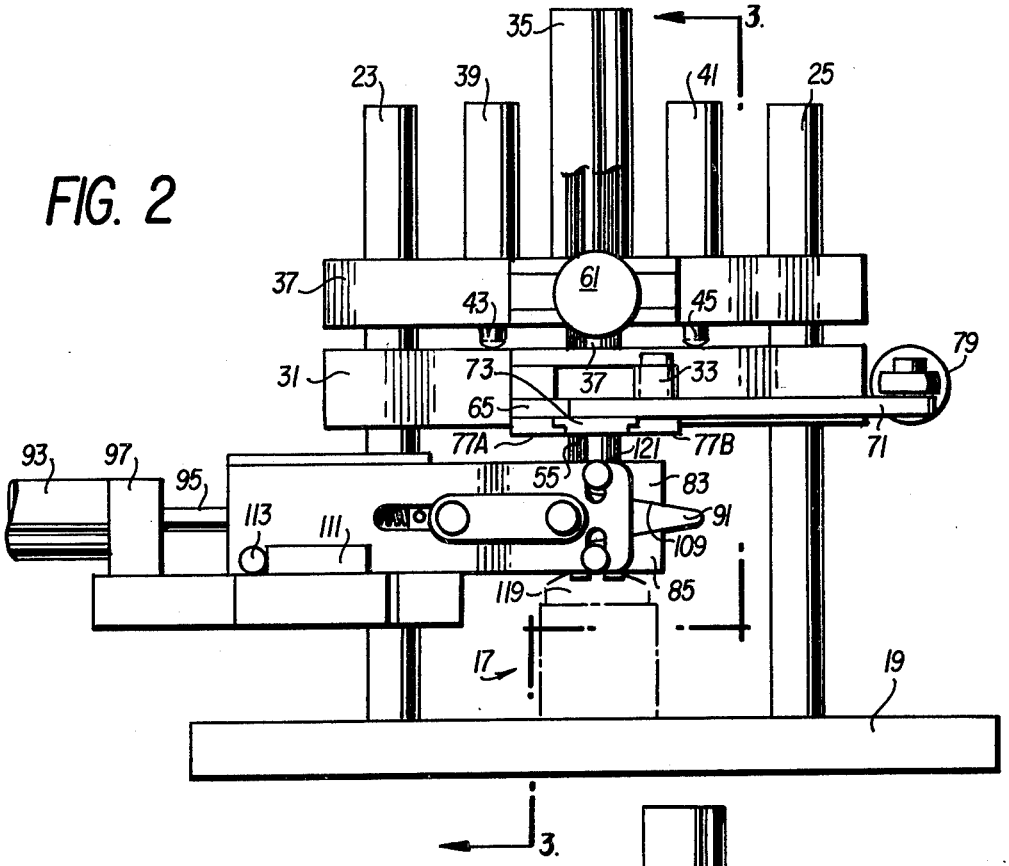
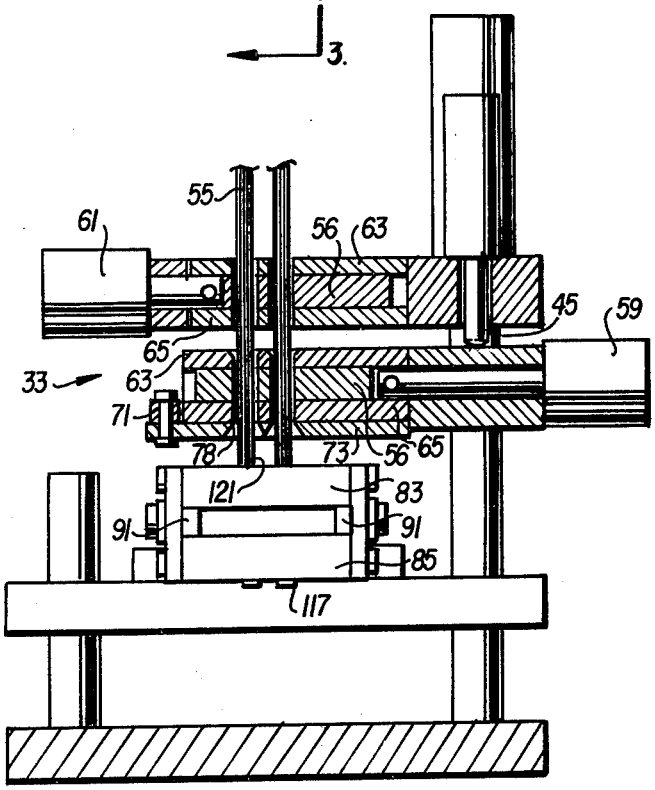
FIG. 3

METHOD AND APPARATUS FOR MOUNTING BRISTLES ON BRUSH BACKS

BACKGROUND OF THE INVENTION

This invention relates broadly to the art of brush manufacturing and, more specifically, to the art of fastening bristles to brush backs.

Normally, in the prior art, to fasten bristles to brush backs, holes are drilled into the brush backs at the positions where brush bristle tufts are to be located. The tufts are then inserted into the holes and retained therein by nails, glue, tuft retainers or the like.

Such a procedure is unduly complicated in that it necessitates the step of first boring holes into the brush backs. Thus, it is an object of this invention to provide a method and machine for mounting bristles on brush backs wherein it is unnecessary to first drill holes in the brush backs.

It is a further object of this invention to provide an uncomplicated method and apparatus for relatively easily adhering brush bristles to brush backs without the application of glue, nails and the like.

It is yet another object of this invention to disclose a machine and method for fusing plastic brush bristles to plastic brush backs.

SUMMARY OF THE INVENTION

According to principles of this invention, the tips of plastic bristle strands and zones of a brush back are heated until they are soft, or partially melted, and the tips of the brush bristle strands are then brought into contact with the zones of the brush back so that they are fused together. The plastic is cooled leaving the bristle strands mounted on the brush back. Thereafter, the strands are cut to the proper lengths.

In carrying out this sequence, the tips of indeterminate-length bristle strands are positioned opposite a brush back in the formation in which they are to be mounted. A heating device is then inserted between the bristle-strand tips and the brush back. The heating device is expanded to contact both the bristle tips and the brush back, thereby heating them and making them soft. The heating device is then retracted from between the bristles and the brush back and a movable plate, which is clamped to the indeterminate-length bristle strands, is moved toward the brush back to bring the bristle-strand tips into contact with the brush back. The movable plate is then unclamped from the bristle strands and moved along the bristles away from the brush back until it is positioned at the desired length of the bristles from the brush back. At this point, a cutting blade on the movable plate cuts the bristles and the movable plate is raised further to remove the brush.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 2 is a front view of the device of FIG. 1, with the heating element thereof in an expended mode; and FIG. 3 is a sectional view taken approximately on line 3—3 of FIG. 2.

DESCRIPTION OF THE PREFERRED EMBODIMENT

Figure 1:
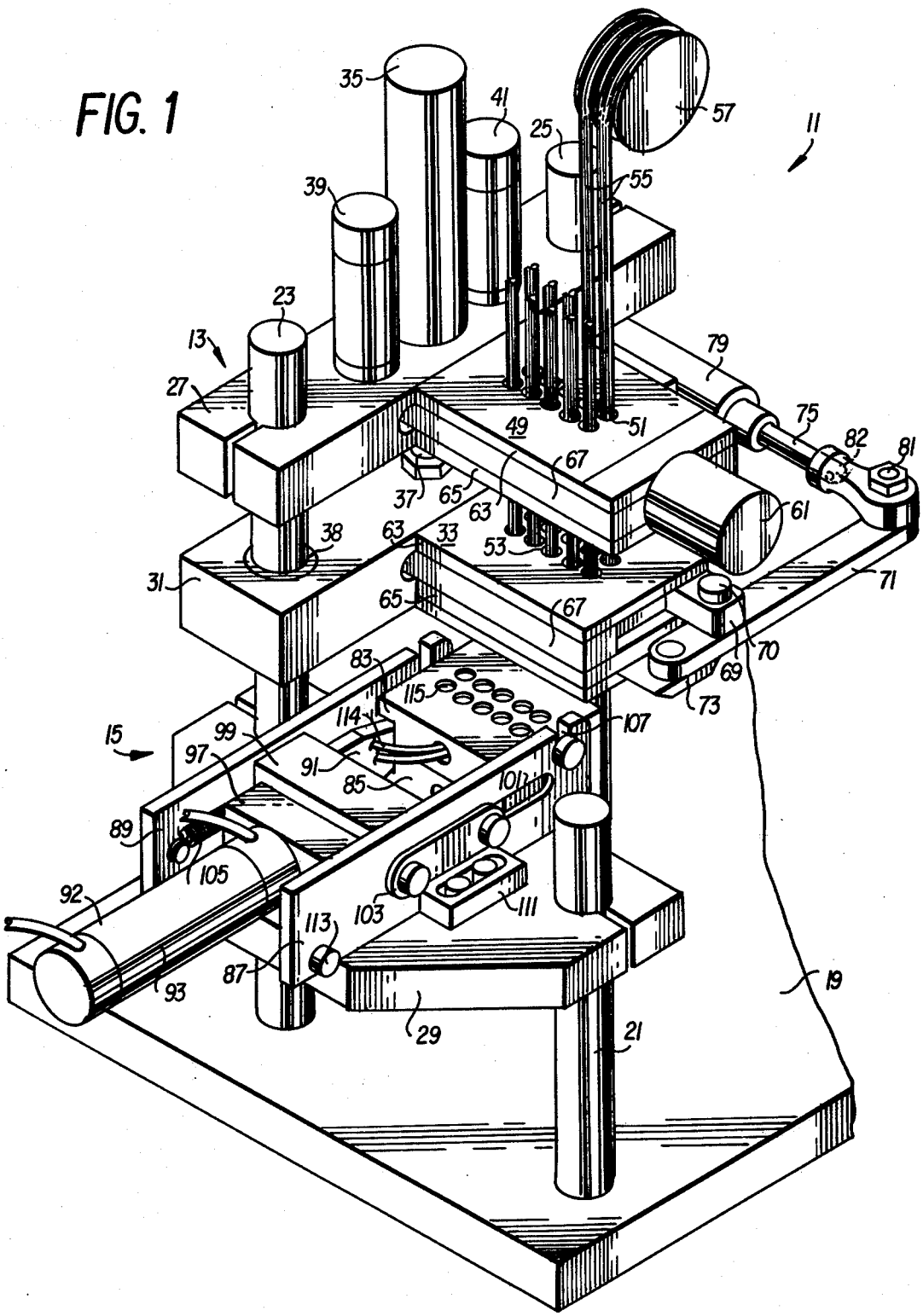
FIG. 1 is an isometric view of a bristle mounting machine employing principles of this invention, with some elements shown schematically.

Referring now to the drawings, and in particular to FIG. 1, a fusing-type bristle mounting machine 11 of this invention includes mainly a bristle feeding mechanism 13, a heating mechanism 15, and a brush back holding stand 17. The entire system is supported from a main support block 19 by means of a front post 21, and two rear posts 23 and 25. A stationary feed-mechanism support block 27 is clamped to the first and second rear posts 23 and 25 to support the bristle feeding mechanism and a stationary heater support block 29 is clamped to the first rear post 23 and to the front post 21 to support the heating mechanism.

With regard to the bristle feeding mechanism 13, this comprises a movable carriage block 31 having a movable bristle clamp block 33 attached thereto which is moved up and down by a cylinder-piston mechanism 35. In this respect, the cylinder-piston mechanism 35 moves a shaft 37 which is attached to the carriage block 31, with the actual cylinder of the cylinder-piston mechanism 35 being mounted on the stationary feed-mechanism support block 27. The carriage block 31 has openings 38 therein which ride on the first and second rear posts 23 and 25 for guidance. First and second cylinder-piston stop mechanisms 39 and 41 drive stops 43 and 45 which are thereby adjusted upwardly and downwardly to stop the carriage block 31 at desired positions.

A stationary bristle clamp block 49 is attached to the stationary block 27.

The movable and stationary bristle clamp blocks 33 and 49 each have corresponding holes 51 and 53 therethrough, through which plastic bristle strands 55 of indeterminate length extend. In this respect, the plastic strands 55 are wound on reels 57 (shown schematically in FIG. 1) or other feed mechanisms. The movable and stationary bristle clamp blocks 33 and 49 have the ability to clamp to the respective plastic bristle strands 55 by means of clamp plates 56 (FIG. 3), so that the bristle strands will not move through the holes 51 and 53 or to unclamp the bristle strands 55 so that they move freely through these holes 51 and 53. These clamp plates 56 have holes therein corresponding to the holes 51 and 53 and are activated by cylinder-piston mechanisms 59 and 61 to shift laterally and thereby bind the strands. The movable and stationary bristle clamp blocks 33 and 49 each include upper and lower bristle plates 63 and 65 with spacer bars 67 between these respective blocks to form spaces for the clamp plates 56. A right spacer bar 69 of the movable bristle clamp block 33 is longer than the other spacer bars and, in fact, extends beyond the main body of the movable bristle clamp block 33 to form a pivot joint 70 for a lever 71.

The lever 71 is attached to a knife 73 at a first end thereof and is pivotally attached to a drive rod 75 at an opposite end thereof. The knife 73 slidably rides in a slot formed by gibs 77 A and B which are mounted to the lower plate 65 of the movable bristle clamp block 33. The knife 73 has holes therethrough, with cutting blades 78 thereat, corresponding with the holes 51 and 53 of the upper and lower plates 63 and 65 of the movable and stationary bristle clamp blocks 33 and 49. When the knife's holes are slid out of alignment with the holes of the lower plate 65 of the movable bristle clamp block 33, then plastic bristle strands 55 extending therethrough are sheared off by interaction between the knife 73 and the lower block 65.

The drive rod 75 is driven by a cylinder-piston mechanism 79 which is mounted at a pivotable mount (not shown) so as to allow the drive rod 75 end of the cylinder-piston mechanism 79 to move upwardly and downwardly. Similarly, pivot joints 81 and 82 between the drive rod 75 and the lever 71 also allow the cylinder-piston mechanism to pivot in two directions to allow upward and downward movement of the lever 71 and to allow the lever 71 to pivot about the pivot joint formed on the spacer bar 69.

Describing next the heating mechanism 15, this includes upper and lower heater block 83 and 85, slidable right and left side plates 87 and 89, wedges 91, and a cylinder-piston mechanism 93. A cylinder 92 of the cylinder-piston mechanism 93 is mounted on a stationary cylinder block 97. A shaft 95, which is driven by the piston of the cylinder-piston mechanism 93, is attached to a yoke 99 which rides in slots 101 (only one can be seen in the drawings) in the respective right and left side plates 87 and 89. In this respect, protruding portions 103 of the yoke 99 actually ride in the slots 101. An extension spring 105 tends to hold the yoke 99 toward the rear of the slot 101, but will allow the yoke 99 to move away from the rear of the slot 101 against the pull of the extension spring 105. Wedges 91 are fixedly attached to the yoke 99 and extend between the upper and lower heater blocks 83 and 85 to force the heater blocks apart (upwardly and downwardly) when the yoke 99 moves forwardly. In this respect, the upper and lower heater blocks 83 and 85 actually float in slots 107 in the right and left side plates but are held together by means of springs (not shown). It should be noted that the upper and lower heater blocks 83 and 85 have beveled complementary surfaces 109 for contacting the beveled surfaces of the wedges 91 to cause the expanding or contracting movements of the upper and lower heater blocks 83 and 85 upon relative movement between the yoke 99 and the right and left side plates 87 and 89.

In addition, the right and left side plates 87 and 89 are slidable along the heater-block support 29. Stop blocks 111 attached to the heater block 29 stop the forward movement of the right and left side plates 87 and 89 upon contact with stops 113 attached to the respective side plates 87 and 89.

It should be noted that the upper heater block 83 has dimples 115 therein corresponding to the locations of bristle strands 55, and that the lower heater block 85 has protruding elements 117 thereon, also corresponding to the positions of the bristle strands 55. The heater blocks 83 and 85 are made of bronze and have a series of tubular electric heater elements (not shown) embedded therein. The heater elements are energized by wires 114.

Describing now the overall operation of the fusing-type bristle mounting machine of the drawings, a brush holder, or brush back 119, made of a suitable plastic such as polypropylene is placed onto the brush-back holding fixture or stand 17 and the machine is turned on. Firstly, the cylinder-piston mechanism 93 is actuated to drive the yoke 99, and the right and left side plates 87 and 89, via the extension spring 105, forwardly to bring the upper and lower heater blocks 83 and 85 between the brush back 119 and bristle tips 121 of the plastic bristle strands 55. These strands 55 are also made of a suitable plastic such as polypropylene. Once the cylinder-piston mechanism 93 has been actuated, a sufficient amount to bring the upper and lower heater blocks 83 and 85 between the bristle tips 121 and the brush back 119, the stop blocks 111 make contact with the stop 113 thereby stopping the forward motion of the right and left side plates 87 and 89. At this point, however, the yoke 99 continues to move forwardly expanding the extension spring 105 and moving the wedges 91 between the upper and lower heater plates 83 and 85 which do not move forward since they ride in slots 107 in the right and left side plates 87 and 89. As the wedges move between the upper and lower heater blocks 83 and 85, the heater blocks expand such that the dimples 115 in the upper heater block make contact with the bristle strand tips 121 and the protusions 117 on the lower heater block 85 make contact with the brush back 119. The cylinder-piston mechanism 93 remains activated a sufficient length of time such that the upper and lower heater blocks 83 and 85 soften, or partially melt, the bristle strand tips 121 and corresponding zones on the brush back. The cylinder-piston 93 is then deactivated, withdrawing the wedges 91 to contract the upper and lower heater blocks 83 and 85 and withdraw them from between the bristle strand tips 121 and the brush back 119.

Now the cylinder-piston 35 is activated to move the movable bristle clamp block 33, which is clamped to the bristle strands 55 by means of the cylinder-piston mechanism 59, downwardly to bring the partially melted bristle strand tips 121 into contact with the partially melted, corresponding zones of the brush back 119 and hold them there until they are fused together.

At this point, the cylinder-piston mechanism 59 deactivates the clamp of the movable bristle clamp block 33 to release the bristle strands 55 and the cylinder-piston mechanism 61 is activated to clamp the stationary bristle clamp block 49 to the bristle strands 55. The cylinder-piston 35 is then energized to move the movable bristle clamp block 33 upwardly until it contacts the stops 43 and 45 which are held in position by the first and second cylinder-piston stop mechanisms 39 and 41. Here, the cylinder-piston mechanism 79 is energized to move the lever 71 and its attached knife 73 to shear the bristles at a desired length. The cylinder-piston mechanisms 39 and 41 are then energized to move their associated stops 43 and 45 upwardly to allow the cylinder-piston mechanism 35 to move the movable bristle clamp block 33 upwardly. The brush back 119 and its attached bristles are then removed and a new brush back is placed into position. The cycle is then repeated.

It should be understood that when the movable bristle clamp block 33 is clamped to the bristle strands and moved downwardly, the stationary bristle clamp block 49 is not clamped to the bristle strands but when the movable bristle clamp block 33 is moved upwardly and is not clamped to the bristle strands, the stationary bristle clamp block 49 is clamped to the bristle strands.

The various cylinder-piston mechanisms described herein are operated hydraulically in a preferred embodiment (hydraulic hookups shown for cylinder-piston mechanism 93 only), however, they could also be operated electrically, pneumatically, etc.

It will be understood by those skilled in the art that the method and mechanism for constructing plastic bristle brushes described herein not only provides a new manner of attaching bristles to brush backs, but also describes an efficient manner in carrying this out.

While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege are claimed are defined as follows:

1. A brush making machine for joining plastic brush bristles with plastic brush backs, said machine comprising:

brush-back holding means for holding said brush back, said brush back having plastic bristle-mounting zones on the outer surface thereof;

bristle-holding means for holding the tips of a plurality of said plastic bristles in a desired arrangement;

heating means for heating said tips of said plastic bristles and for heating said bristle mounting zone of said brush back for partially melting said bristle tips and said bristle mounting zones; and means for moving said brush-back holding means and said bristle-holding means toward one another to bring said partially melted bristle tips into contact with said partially melted brush-back bristle mounting zones, thereby fusing said bristles to said brush back.

2. A brush making machine as in claim 1 wherein said brush and bristle holding means are located opposite one another.

3. A brush making machine as in claim 2 wherein said heating means includes a means for moving heated elements between said brush-back holding means and said bristle holding means, a means for expanding said heating elements to come into contact with tips of bristles held by said bristle-holding means and with a brush back held by said brush-back holding means to heat said bristle tips and said brush-back simultaneously and a means for contracting said heating elements away from said bristle tips and said brush back and thereafter retracting said heating elements from between said brush-back holding means and said bristle-holding means.

4. A brush making machine as in claim 3 wherein said heating element expanding means comprises a wedge which moves between said heating elements causing said heating elements to move apart from one another and thereby expand.

5. A brush making machine as claimed in claim 2 wherein said bristle-holding means comprises a movable plate and a stationary plate, each of said plates having apertures therethrough for receiving bristle strands of indeterminate lengths, said movable plate including means for clamping said movable plate to said strands, said means for moving being attached to said movable plate for moving the movable plate to bring the tips of said strands into contact with said brush back after said tips and brush back have been heated.

6. A brush making machine as in claim 5 wherein said means for clamping is also for unclamping said movable plate from said strands for allowing said movable plate to move to another position on said strands, and wherein said movable plate includes a cutting means for cutting said strands at said other position.

7. A brush making machine as in claim 6 wherein said heating means includes a means for moving heated elements between said brush-back holding means and said bristle-holding means, a means for expanding said heating elements to come into contact with tips of bristles held by said bristle-holding means and with a brush back held by said brush-back holding means to heat said bristle tips and said brush-back simultaneously and a means for contracting said heating element away from said bristle tips and said brush back and thereafter retracting said heating elements from between said brush-back holding means and said bristle-holding means.

8. A brush making machine as in claim 7 wherein said heating element expanding means comprises a wedge which moves between said heating elements causing said heating elements to move apart from one another and thereby expand.

9. A brush making machine as in claim 5 wherein said heating means includes a means for moving heated elements between said brush-back holding means and said bristle holding means, a means for expanding said heating elements to come into contact with tips of bristles held by said bristle-holding means and with a brush back held by said brush-back holding means to heat said bristle tips and said brush-back simultaneously and a means for contracting said heating element away from said bristle tips and said brush back and thereafter retracting said heating elements from between said brush-back holding means and said bristle holding means.

10. A brush making machine as in claim 9 wherein said heating element expanding means comprises a wedge which moves between said heating elements causing said heating elements to move apart from one another and thereby expand.

11. A method for mounting plastic brush bristles on bristle-mounting portions of a plastic brush back comprising the steps of holding the tips of bristle strands and the brush back opposite one another, moving a heating element between said bristle tips and said brush back, simultaneously bringing said bristle tips and said brush back into contact with said heating element to heat the tips of the thusly-held brush bristles and the bristle-mounting portions of the thusly-held plastic brush back until they are partially melted, moving said heating element from between said bristle tips and said brush back and bringing the partially melted bristle tips into contact with said partially melted brush back, and cooling said partially melted tips and said partially melted portions of said plastic brush back, thereby fusing said bristles to said brush back.

12. The method as in claim 11, wherein is further included the step of heating said bristle strands with a movable plate which can be clamped to, and unclamped from, said bristle strands.

13. A method as in claim 12 wherein is further included the step of cutting said bristle strands with a cutting device attached to said moving plate.

* * * * *